US011684177B2

(12) United States Patent
Rogers et al.

(10) Patent No.: US 11,684,177 B2
(45) Date of Patent: Jun. 27, 2023

(54) CONVERTIBLE CHILDREN'S SEAT

(71) Applicant: KIDS2, INC., Atlanta, GA (US)

(72) Inventors: Bradford Joseph Rogers, Decatur, GA (US); Frank M. Tyneski, Roswell, GA (US); Tsz Kin Ho, Hong Kong (CN)

(73) Assignee: KIDS2, INC., Atlanta, GA (US)

( * ) Notice: Subject to any disclaimer, the term of this patent is extended or adjusted under 35 U.S.C. 154(b) by 0 days.

(21) Appl. No.: 17/575,826

(22) Filed: Jan. 14, 2022

(65) Prior Publication Data

US 2022/0225790 A1 Jul. 21, 2022

Related U.S. Application Data

(60) Provisional application No. 63/137,797, filed on Jan. 15, 2021.

(51) Int. Cl.
*A47D 13/10* (2006.01)
*A47D 1/08* (2006.01)

(52) U.S. Cl.
CPC ..... *A47D 13/107* (2013.01); *A47D 1/08* (2013.01); *A47D 13/102* (2013.01)

(58) Field of Classification Search
CPC ..... A47D 1/08; A47D 13/102; A47D 13/107
USPC ..... 297/131
See application file for complete search history.

(56) References Cited

U.S. PATENT DOCUMENTS

| | | | | |
|---|---|---|---|---|
| 5,178,438 | A | 1/1993 | Berger | |
| 5,203,611 | A | 4/1993 | Greenwood et al. | |
| 6,540,292 | B2 | 4/2003 | Darling et al. | |
| 6,682,148 | B1 | 1/2004 | Chen | |
| 6,811,217 | B2 | 11/2004 | Kane et al. | |
| 8,079,639 | B2 | 12/2011 | Zeng et al. | |
| 8,746,794 | B2 | 6/2014 | Oren et al. | |
| 2011/0260507 | A1 | 10/2011 | Parness et al. | |
| 2012/0235450 | A1 | 9/2012 | Oren et al. | |
| 2016/0037942 | A1* | 2/2016 | Guozhu | A47D 13/107 297/274 |

FOREIGN PATENT DOCUMENTS

| | | | | |
|---|---|---|---|---|
| CN | 112167887 | A | 1/2021 | |
| JP | 2007159709 | A * | 6/2007 | A47D 13/107 |
| JP | 2007167503 | A * | 7/2007 | A47D 13/102 |

* cited by examiner

*Primary Examiner* — Milton Nelson, Jr.
(74) *Attorney, Agent, or Firm* — Gardner Groff & Greenwald, PC

(57) ABSTRACT

A convertible children's seat that can be used as a bouncer, a rocker, or as a stationary seat. The convertible children's seat provides a grow-with-me aspect to a typical children's seat by allowing the seat to change to fit the needs of the child as he/she grows and develops.

17 Claims, 4 Drawing Sheets

CONVERTIBLE CHILDREN'S SEAT

CROSS-REFERENCE TO RELATED APPLICATION

This application claims the benefit of U.S. Provisional Patent Application Ser. No. 63/137,797 filed Jan. 15, 2021, the entirety of which is hereby incorporated herein by reference for all purposes.

TECHNICAL FIELD

The present disclosure relates generally to the field of infant and children's gear, and more particularly to a rocker that is convertible into a children's seat or a children's bouncer.

BACKGROUND

Children's supporting devices such as seats, rockers, bouncers, sleepers, bassinets, and the like are commonly used to hold infants and other small children during rest, play, and entertainment. Infants are supported in a supine position whereas toddlers and other small children are supported in a more inclined position. In some cases, a caregiver must acquire a new seat or rocker when the child grows from an infant to a toddler. Continuing developments and improvements are sought in the field of child seats and rockers that accommodate the seating position of both infants and toddlers.

It is to the provision of a children's seat convertible between different modes meeting these and other needs that the present disclosure is primarily directed.

SUMMARY

In example embodiments, the present disclosure provides a convertible children's seat that may be interchangeable between a rocker mode, a bouncer mode, and a stationary seat mode.

In one aspect, the present disclosure relates to a children's seat for supporting a child over a support surface. The children's seat includes a child support port and a base portion. The base portion is reconfigurable so at to allow selective use of the children's seat as a bouncer, a rocker, or a stationary chair. In example embodiments, the base portion includes a base frame with one or more base members having curved or rounded bottom surfaces. The base portion further includes a kickstand that is pivotally coupled to the base portion and is pivotable between an extended position and a retracted position with the kickstand engaging the support surface in the extended position. The base portion further includes a bouncer frame with base support members having first ends and second ends opposite the first ends, a front crossbar extending between the first ends of the base support members, and upwardly angled extending side members extending from the second ends of the base support members. In example embodiments, the bouncer frame is detachably coupled to the base portion and is reconfigurable between an extended position and a retracted position, the bouncer frame engaging the support surface in the extended position. The base portion may further include one or more feet or stoppers. In example embodiments, the child support portion includes a seat assembly adapted for receiving and securing a child or infant. The child support portion may also include a motion control device which departs motion to the child support portion.

In another aspect, the present disclosure relates to a convertible children's seat. The convertible children's seat includes a base frame, a seat assembly, a kickstand, and a bouncer frame. The convertible children's seat is configured for selective use in a bouncer mode, a rocker mode, and a stationary chair mode. In example embodiments, the kickstand and bouncer frame are connected to the base frame and each of the kickstand and bouncer frame is selectively reconfigurable between an extended position and a retracted position. In the bouncer mode, the kickstand and the bouncer frame are in the extended positions. In the rocker mode, the kickstand and the bouncer frame are in the retracted positions. In the stationary chair mode, the kickstand is in the extended position while the bouncer frame is in the retracted position.

In yet another aspect, the present disclosure relates to a method of converting a 3-in-1 children's seat between a bouncer mode, a rocking mode, and a stationary mode, the children's seat having a seat assembly supported by a base frame with a kickstand moveable between an extended position and a retracted position and a bouncer frame moveable between an extended position and a retracted position. The method includes moving both the kickstand and the bouncer frame to the extended positions for the bouncing mode, moving both the kickstand and the bouncer frame to the retracted position for the rocker mode, and moving the kickstand to the extended position and the bouncer frame to the retracted position for the stationary mode.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the disclosure, and are not restrictive of the disclosure, as claimed.

DETAILED DESCRIPTION OF EXAMPLE EMBODIMENTS

Figure 1:
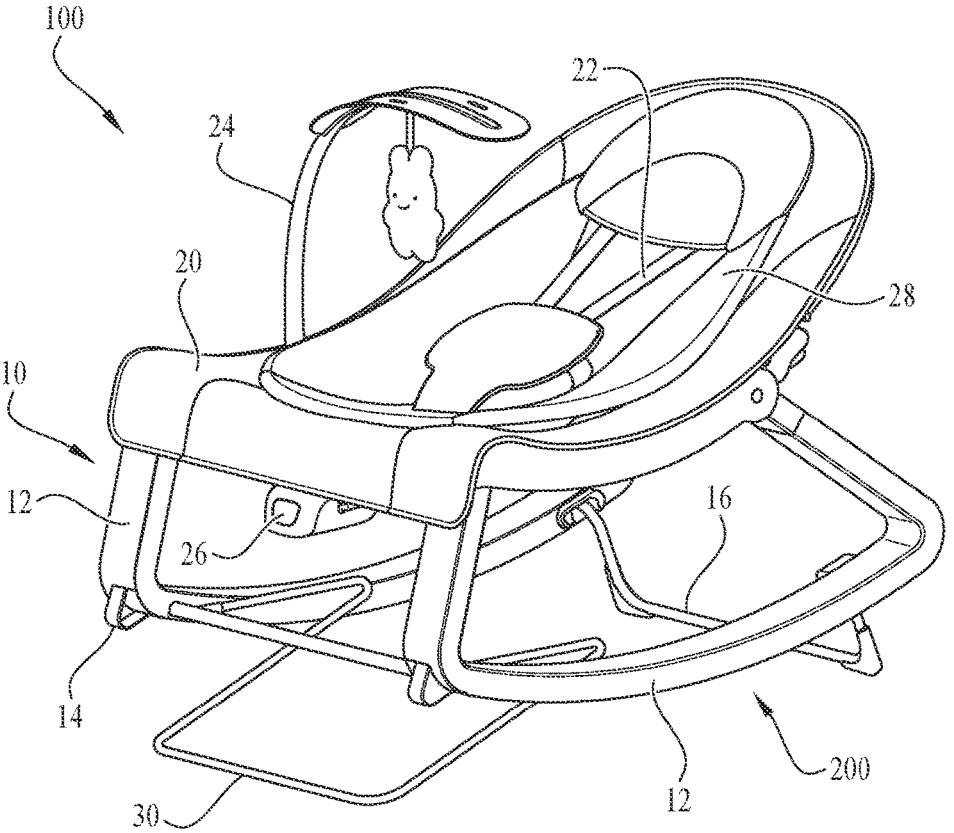
FIG. 1 is a perspective view of a convertible children's seat according to an example embodiment.

The present disclosure may be understood more readily by reference to the following detailed description of example embodiments taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-4C show a plurality of examples of a convertible children's seat 100 that may be converted into a bouncer, a rocker, or a stationary seat according to example embodiments of the present disclosure. In example embodiments, the convertible children's seat comprises a support frame 10, a seat assembly 20, and a bouncer frame 30.

In example embodiments, the frame 10 is constructed of any suitable material such as, for example, plastic, metal, wood, polymer, composite, or other suitably rigid materials known in the art. In particular embodiments, the seat assembly 20 is formed from soft goods attached to the frame 10. In some embodiments, the seat assembly 20 further comprises additional padding 28 for providing comfort and support to an infant or toddler using the children's seat 100. The seat assembly 20 also includes a harness 22 configured to be selectively attached to the seat assembly 20 to secure a child in the seat. In particular embodiments, a toy bar 24 is releasably and rotatably coupled to the frame 10. One or more toys or other soothing/entertaining devices may be releasably or fixedly coupled to the toy bar 24. As shown in FIG. 1, the convertible children's seat 10 may further include a control device 26 secured to a front portion of the seat assembly 20. In other embodiments, the control device 26 may be permanently secured to the seat assembly 20. The control device 26 may be used to impart a bouncing motion, a rocking motion, or a vibration onto the convertible children's seat 10. In some embodiments, the control device 26 may also store and play music or other sounds to soothe an infant seated in the children's seat.

FIG. 1 shows the convertible children's seat 100 in a bouncer mode 200. According to various embodiments, the frame 10 includes left and right frame or base members 12. The left and right base members or legs 12 are mirror images of each other and have a generally trapezoidal shape. In example embodiments, the left and right base members 12 have a curved bottom surface enabling the children's seat 100 to rock when placed on a support surface such as for example the floor or the ground. In alternate embodiments, the legs or base members may be any suitable shape having a rounded, rocking base or bottom surface. In particular embodiments, the curved bottom may include one or more interference members 14 such as feet, stoppers, etc., for limiting the rocking movement of the children's seat while in the rocker mode. For example, in the depicted embodiment, the children's seat 100 includes front feet 14 for limiting the forward rocking motion of the rocker. In alternate embodiments, the children's seat 100 may include front and rear feet for limiting the forward and backward rocking motion of the rocker.

In particular embodiments, the children's seat 100 also includes a rear kickstand 16. The kickstand 16 is pivotally coupled to the left and right base members 12 and is selectively moveable between an extended position and a retracted position. According to example embodiments, the kickstand 16 can be extended to engage the support surface to prevent the children's seat 100 from rocking for example in the stationary or bouncer modes. In the retracted or folded position, the kickstand 16 is selectively pivoted or otherwise moved so that it does not engage the support surface, and therefore, the children's seat is able to rock, depending upon the position of the bouncer frame 30. In example embodiments, the kickstand 16 is pivotally coupled to the frame members 12 with any suitable fastening mechanism such as screws, bolts, rivets, adhesive, welding, friction fit, etc. In some embodiments, the kickstand 16 may be releasably coupled to the children's seat 100 so as to allow the kickstand 16 to be removed entirely from the frame 10 when the kickstand is not needed.

Figure 2:
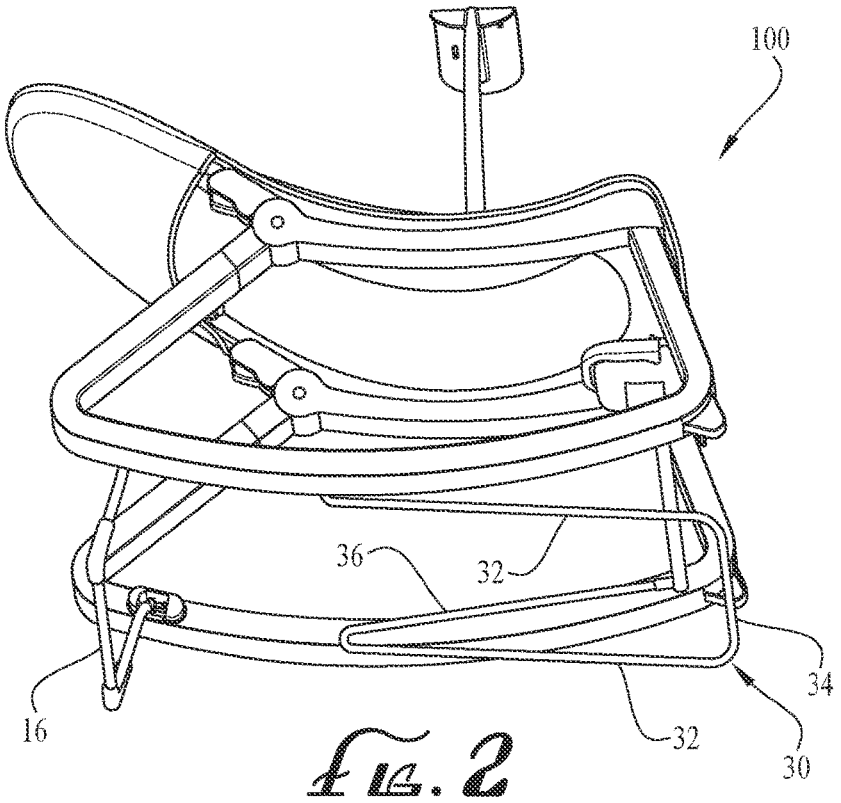
FIG. 2 is a bottom, side perspective view of the convertible children's seat of FIG. 1 according to an example embodiment, showing the convertible children's seat in a children's seat mode.
Figure 3A:
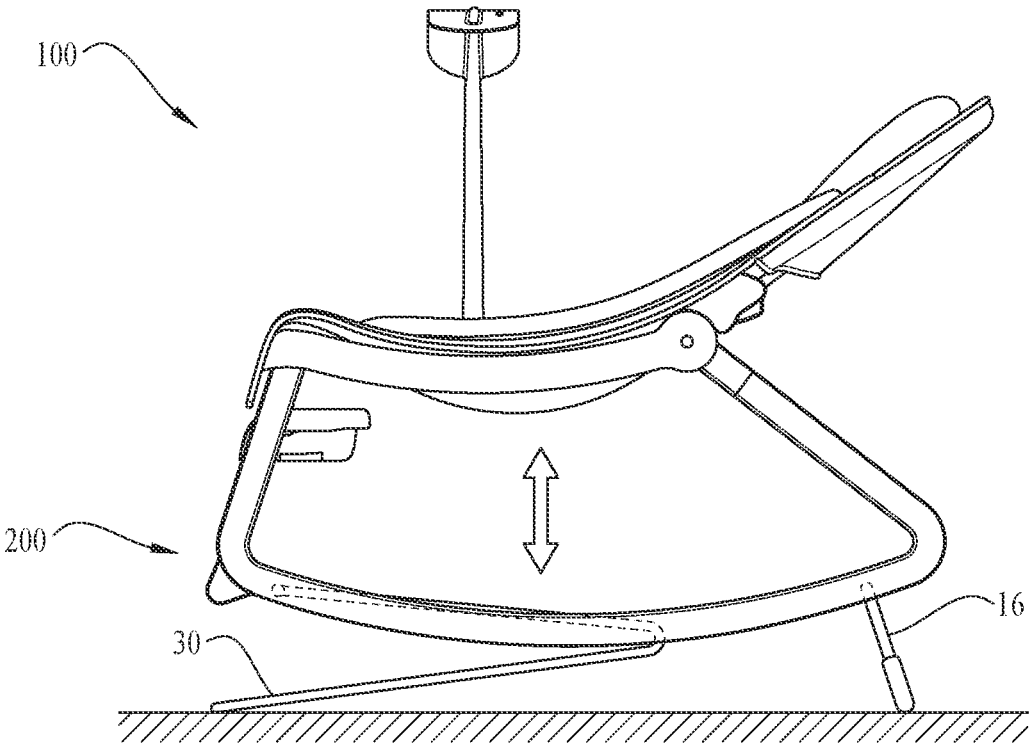
FIG. 3A shows the convertible children's seat of FIG. 1 in a bouncer mode.
Figure 3B:
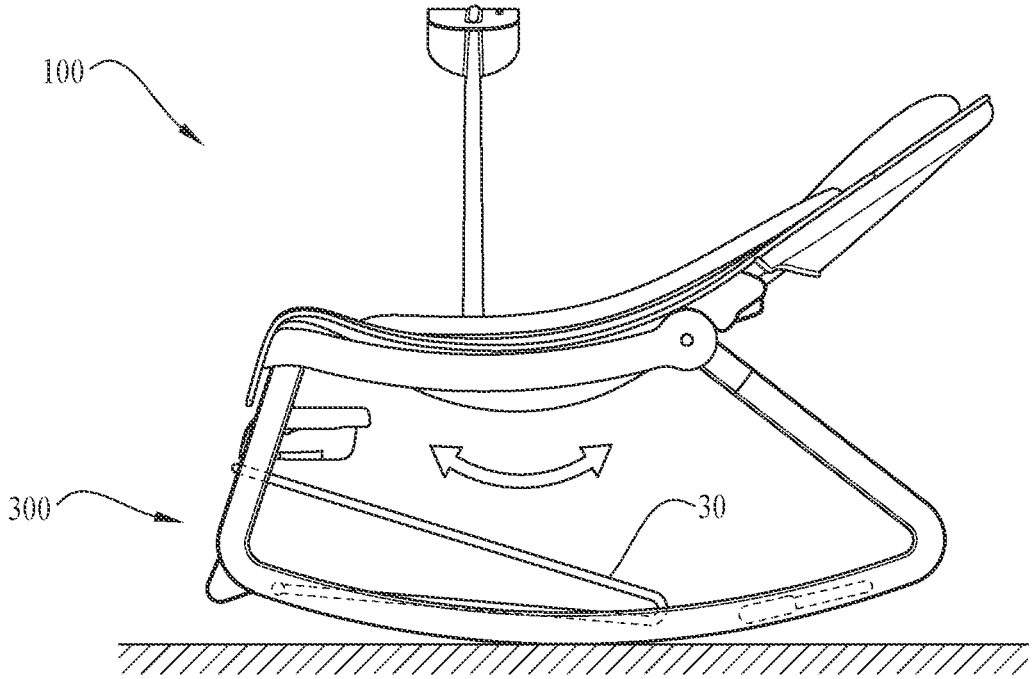
FIG. 3B shows the convertible children's seat of FIG. 1 in a rocker mode.
Figure 4A:
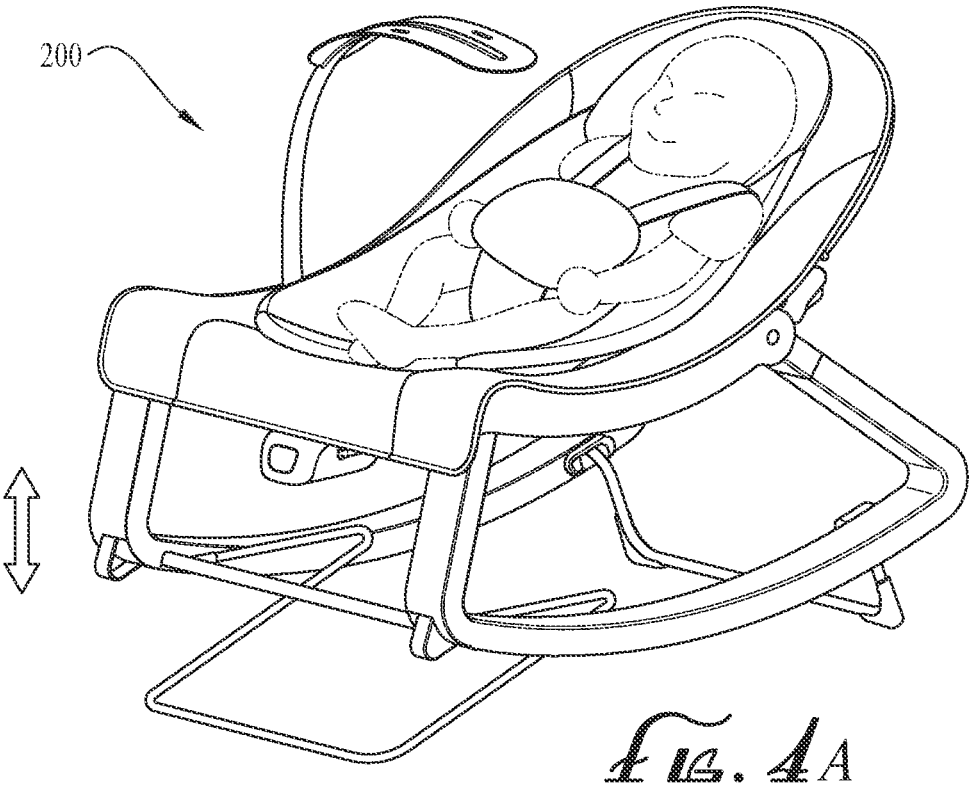
FIGS. 4A-4C show the convertible children's seat of FIG. 1, showing the convertible children's seat in various modes of use.

Referring to FIGS. 1 and 2, the bouncer frame 30 includes base support members 32 having a front crossbar 34, and a pair of upwardly and forwardly extending side members 36 that extend from the rear ends of the base support members 32. In the depicted embodiments, the base support members 32, the front crossbar 34, and the upwardly extending side members 36 are integrally formed from a suitable resilient material, such as for example, metal. Further, the upwardly extending side members 36 are resiliently deflectable downwardly toward the base support members 32. According to example embodiments, the bouncer frame 30 is selectively reconfigurable between an extended position and a retracted position. In the extended position, the bouncer frame 30 engages the support surface and provides an elastic or spring-like support to allow for example the front end of the children's seat 100 to bounce up and down, as shown in FIGS. 3A and 4A. For example, when an infant is placed in the convertible children's seat 100, the infant can be gently bounced by applying pressure to the seat assembly 20, for example the front or the back of the seat assembly, such that the upwardly extending side members 36 are resiliently bent downwardly slightly and then resiliently returned to the original position. In other words, the bouncer frame 30 is configured to facilitate a bouncing motion as shown in FIG. 4A. The bounce mode can be engaged with or without the kickstand 16 in the extended position. In the retracted position, the bouncer frame is positioned so that it does not engage the support surface and the seat is supported substantially by the frame members 12, as shown in FIG. 3B. In alternate embodiments, the bouncer frame 30 may comprise a plurality of components, for example the base support members 32, the front crossbar 34, and the upwardly extending side members 32, which can be joined or otherwise assembled together to form the bouncer frame.

Figure 3C:
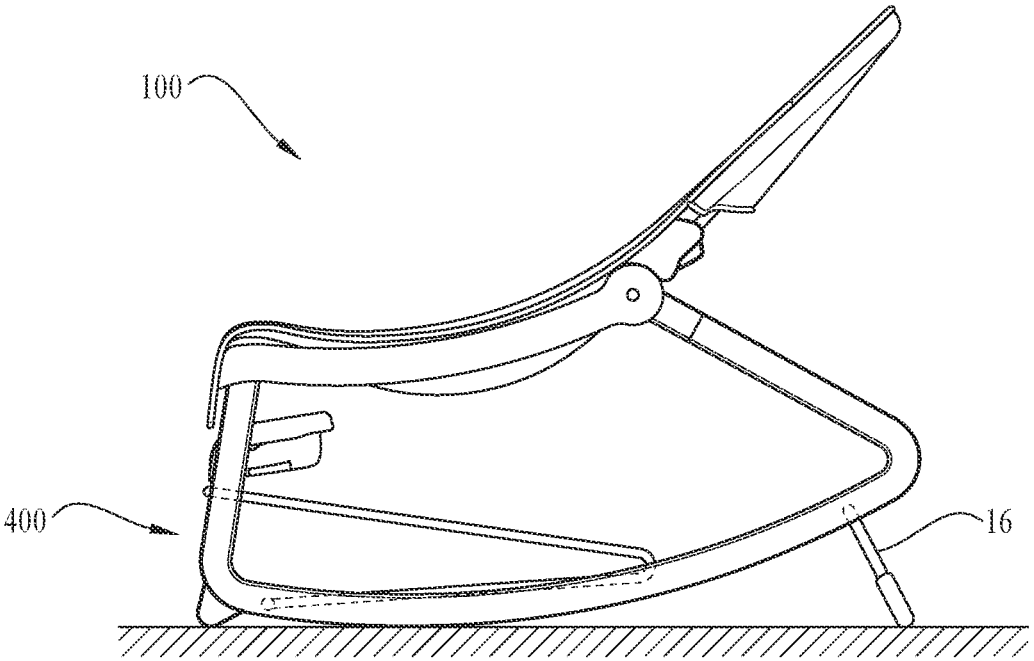
FIG. 3C shows the convertible children's seat of FIG. 1 in a stationary chair mode.

As shown in FIGS. 3A-3B, to convert the convertible children's seat 100 from the bouncer mode 200 to the rocking mode 300, the bouncer frame 30 is removed from the base members 12. The bouncer frame is then rotated 180°, or upside-down, and then reattached to the base members 12 so that the bouncer frame does not engage the support surface. In example embodiments, the bouncer frame 30 is coupled to the base members via a post or peg on the bouncer frame that may be inserted into openings in the base members 12. In alternate embodiments, the bouncer frame 30 may be releasably attached to the frame 10 via any suitable method. To convert the convertible children's seat 100 from the rocking mode 300 to the stationary mode 400, the kickstand 16 is pivoted or otherwise positioned so that it engages the support surface, as shown in FIG. 3C. According to example embodiments, the children's seat is supported by the front feet 14 and the kickstand 16 in the stationary mode 400. In example embodiments, the kickstand 16 elevates the rear end of the children's seat so the seat is positioned more vertically than it is in the rocking or bouncer modes to allow more of an upright seated position rather than a lying position. See FIG. 4C.

Figure 4B:
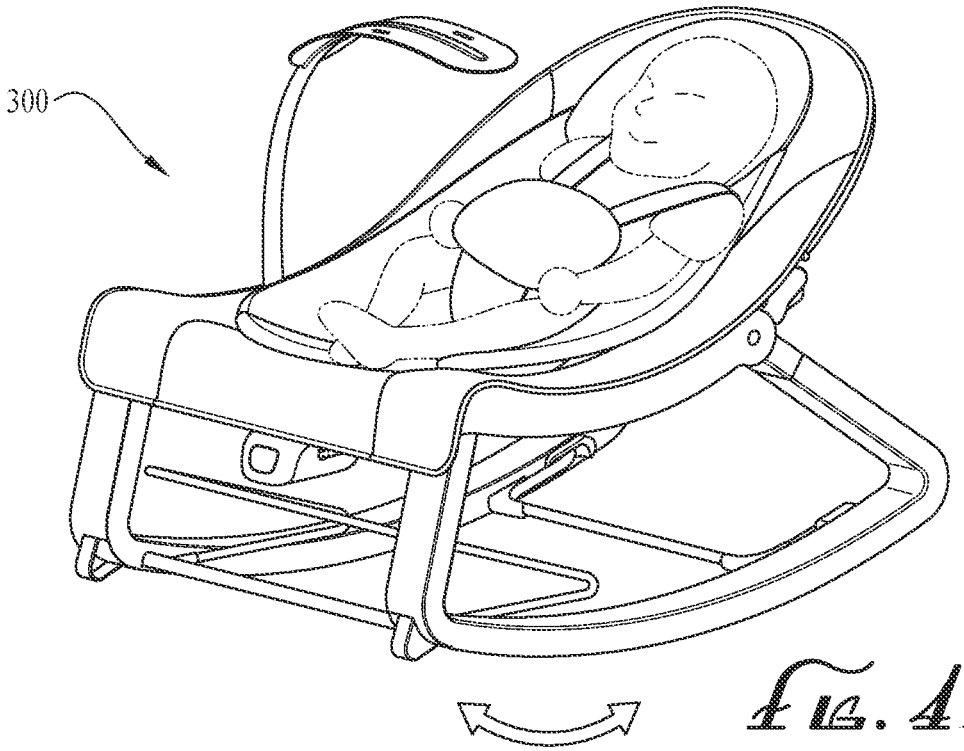
Figure 4C:
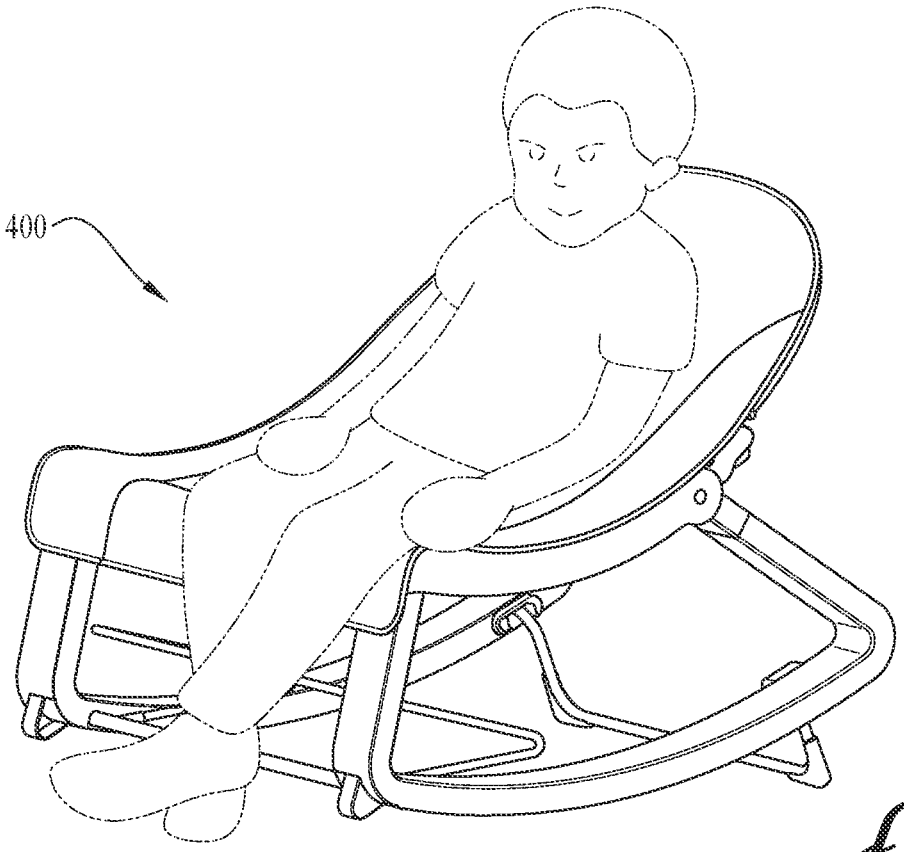

FIGS. 4A-4C depict the grow-with-me aspect of the convertible children's seat 100. The grow-with-me aspect allows the seat to adapt to fit the needs of the child as he/she grows and develops. For example, during the first few months of an infant's life, a care-taker can use the bouncer mode 200 to soothe the infant. As the infant grows and develops more muscle control, the rocking mode 300 may be used to calm the child. Finally, once the child becomes a toddler and is able to stand or stay seated upright on his/her own, the convertible children's seat 10 can be converted to be used as a stationary seat 400, with or without the additional padding.

While the disclosure has been described with reference to example embodiments, it will be understood by those skilled in the art that a variety of modifications, additions and deletions are within the scope of the disclosure, as defined by the following claims.

What is claimed is:

1. A children's seat for supporting a child over a support surface, the children's seat comprising:

a child support portion;

a base portion that and child support portion supports the is reconfigurable to allow selective use of the children's seat as a bouncer or a rocker, a base frame includes the base portion wherein and a bouncer frame, wherein the base frame includes one or more rocker members having curved or rounded bottom surfaces that enable the child seat portion to rock back and forth support surface on the when the children's seat is configured as the rocker, and wherein the includes bouncer frame one or more resilient members that are configurable in an extended position in which at least a portion of resilient members the are positioned at a lower elevation than at least a portion of the rocker members engage and as is configured children's seat so that the support surface the bouncer with at least a portion of the rocker members engaging the support surface not, wherein in the extended position resilient members the, support surface interfere with the child seat portion rocking back and forth on the at least partially support the child seat portion, and have a resiliency that enables the supported child seat portion to resiliently bounce up and down, and wherein when not in the extended position resilient members the do engage note support surface with the resilient members not interfering with the child seat portion rocking back and forth on the rocker the as is configured children's seat so that the support surface.

2. The children's seat of claim 1, wherein the resilient members are further reconfigurable to a retracted position in which the resilient members are positioned above the rocker members and do not engage the support surface so that the children's seat is configured as the rocker with the resilient members not interfering with the child seat portion rocking back and forth on the support surface.

3. The children's seat of claim 1, wherein the child support portion comprises a motion control device which imparts motion to the child support portion.

4. The children's seat of claim 1, wherein the base portion further comprises a kickstand.

5. The children's seat of claim 4, wherein the kickstand is pivotally coupled to the base frame.

6. The children's seat of claim 4, wherein the kickstand is pivotable between an extended position and a retracted position, the kickstand engaging the support surface in the extended position so that the children's seat is reconfigured to allow selective use as a stationary chair.

7. The children's seat of claim 1, wherein the child support portion comprises a seat assembly adapted for receiving and securing a child.

8. The children's seat of claim 1, wherein the members include resilient two base support members having first ends and second ends opposite the first ends, a front crossbar member extending between the first ends of the base support members, and upwardly angled extending side members extending from the second ends of the base support members.

9. The children's seat of claim 1, wherein the bouncer frame is detachably coupled to the base frame.

10. The children's seat of claim 1, wherein the base portion comprises one or more stoppers.

11. A method of converting a children's seat between a bouncer mode, a rocking mode, and a stationary mode, the children's seat having a seat assembly supported by a base frame with a kickstand moveable between an extended position and a retracted position and a bouncer frame moveable between an extended position and a retracted position, the method comprising:

moving both the kickstand and the bouncer frame to the extended positions for the bouncing mode, wherein the kickstand and the ha bouncer frame the, and wherein support surface rocking back and forth on the seat assembly bouncer frame engage the support surface to interfere with thesto be resiliently bounced up and down seat assembly a resiliency that allows the;

moving both the kickstand and the bouncer frame to the retracted position for the rocker mode, support surface rocking back and forth on the seat assembly wherein the kickstand and the bouncer frame do not engage the support surface and thereby do not to interfere with the and moving the kickstand to the extended position and the bouncer frame to the retracted position for the stationary mode support surface rocking back and forth on the seat assembly, wherein the kickstand engages the support surface to interfere with the.

12. A convertible children's seat, comprising:

a seat assembly;

a base frame that supports the seat assembly;

a kickstand that is reconfigurable between an extended position and a retracted position; and a bouncer frame that is reconfigurable between an extended position and a retracted position, wherein the convertible children's seat is configured for selective use in with the bouncer frame and the kickstand in their retracted position a rocker modes, a bouncer mode with the bouncer frame in the extended position, or a stationary seat mode with the kickstand in the extended position and the bouncer frame in the retracted position, one or more wherein the base frame includes rigid that enable the members having curved or rounded bottom surfaces rocker seat assembly when the children's seat is configured support surface to rock back and forth on the in the rocker mode, ed position ractetrin the bouncer frame wherein the is positioned above the rocker members, is engaging the support surface not, and is not interfering with the seat assembly the position extended in the, and support surface rocking back and forth on the is bouncer frame engage positioned below the rocker members and is the support surface, with engaging the support surface at least a portion of the rocker members not, with the bouncer frame interfering with the seat assembly support surface rocking back and forth on the, with the bouncer frame at least partially supporting the, seat assembly and bouncer frame with the having a resiliency that allows the seat assembly to resiliently bounce up and down.

13. The convertible children's seat of claim 12, wherein the bouncer frame includes one or more resilient members having a resiliency that allows the seat assembly to resiliently bounce up and down when the bouncer frame is in the extended position.

14. The convertible children's seat of claim 12, wherein the bouncer frame comprises base support members having first ends and second ends opposite the first ends, a front crossbar member extending between the first ends of the base support members, and upwardly angled extending side members extending from the second ends of the base support members.

15. The convertible children's seat of claim 12, wherein the kickstand and the bouncer frame are each connected to the base frame.

16. The convertible children's seat of claim 12, wherein the bouncer mode further comprises the kickstand in the extended position.

17. The convertible children's seat of claim 12, wherein the kickstand in the retracted position does not engage the support surface and thereby does not interfere with the seat assembly rocking back and forth on the support surface, and in the extended position the kickstand engages the support surface and thereby interferes with the seat assembly rocking back and forth on the support surface.

* * * * *